US006817899B1

(12) United States Patent
Zerebilov

(10) Patent No.: US 6,817,899 B1
(45) Date of Patent: Nov. 16, 2004

(54) ANGLED CONNECTOR FOR COAXIAL CABLE

(75) Inventor: Arkady Y. Zerebilov, Lancaster, PA (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 10/409,182

(22) Filed: Apr. 9, 2003

(51) Int. Cl.[7] ..... H01R 9/05
(52) U.S. Cl. ..... 439/582; 439/585
(58) Field of Search ..... 439/582, 578, 439/579, 580, 581, 583, 584, 585, 271

(56) References Cited

U.S. PATENT DOCUMENTS 4,173,386 A * 11/1979 Kauffman et al. ..... 439/580
4,799,900 A 1/1989 Capp et al.
5,061,206 A 10/1991 Kawanami et al.
5,088,937 A 2/1992 Gabany
5,116,245 A * 5/1992 Baker ..... 439/581
5,362,255 A 11/1994 Anhalt
5,466,174 A 11/1995 Savage, Jr.
6,126,482 A 10/2000 Stabile
6,419,521 B2 7/2002 Kanagawa et al.

* cited by examiner

*Primary Examiner*—Gary Paumen
*Assistant Examiner*—James R. Harvey
(74) *Attorney, Agent, or Firm*—Daniel R. Edelbrock

(57) ABSTRACT

An angled connector has a main body and a cover hinged to the main body. When the cover is in an open position, the main body receives a bent terminal attached to a coaxial cable. When the cover is swung to a closed position on the main body, the main body and cover form a particularly configured or tuned cavity that follows the bend of the terminal. The cavity has walls spaced from but shaped to match the bend in the terminal, providing a smooth direction transition to minimize radio frequency interference caused by the change in direction of a signal through the terminal. A ferrule on the cable is slid over engaging parts of the cover and main body to hold the cover in the closed position and secure the terminal in the connector. The cavity could use air as a dielectric or could be lined with a dielectric member. The dielectric member is fit around the bent terminal. The dielectric member has hinged pieces if needed to enable ease of assembly of the terminal and connector. The tuned cavity configuration is also intended for use in a printed circuit board connector for a coaxial cable.

7 Claims, 18 Drawing Sheets

ANGLED CONNECTOR FOR COAXIAL CABLE

BACKGROUND OF THE INVENTION

1. Field of the Invention

This invention relates in general to electrical connectors for coaxial cable and more particularly to an angled connector for receiving a bent electrical terminal attached to, or for attachment to, a coaxial cable.

2. Discussion of Related Art

In transmitting a signal through a central conductor of a coaxial cable, it is generally preferred to have noise-free transmission. More specifically, it is desired to minimize radio frequency (RF) interference and noise levels. However, routing of coaxial cables often requires the cables to be arranged perpendicularly or at other angles to the connection ports or printed circuit boards they serve. In general, the cables lack the flexibility needed to make sharp bends at the locations of these ports and boards. Therefore, rather than bending the cables, terminals for connecting the cables to the connection ports and printed circuit boards are typically bent to provide the needed turn. For example, U.S. Pat. No. 6,126,482 discloses a right-angle terminal for crimping to a cable conductor and making a right angle turn to a mating contact end for receipt by a cooperating connection port.

It is common practice to utilize a soldered joint for terminating cable center conductors to the bent terminal, or to provide a right angle connection, as illustrated for instance by U.S. Pat. No. 4,799,900. Soldered joints are typically more expensive and time consuming than the simpler crimp connections, and usually must be done after the wire end and terminal are placed in the connector. However, both soldered and crimped joints reduce the RF performance of the connection. Significant geometry variations in the signal path caused by the bend area of the terminal instigate further interference and noise.

The cable end, terminal connection and terminal contact are usually enclosed by an angled connector to protect the terminal and shield the connection, such as disclosed in U.S. Pat. No. 5,362,255. In this patent, a right-angle terminal-to-wire engagement is surrounded by a right-angle, hinged connector. Since the cable termination is a soldered joint and the connector does not grip an inner portion of the wire, the connector has to be securely attached to a conventional braiding layer of the cable to prevent the cable from being pulled out of the connector. This requires a separate tool to spread out the cable braiding prior to the soldering process, adding a step to the assembly procedure. After the hinged connector components are closed around the terminal connection and stripped end of the cable, a sleeve slides over the spread braiding to deform it into a tubular shape surrounding the engaged parts of the components. The sleeve is then crimped in position. This holds the hinged components closed around the joint and mechanically secures the braiding, and therefore the cable, to the connector.

In the above-described devices, and in other standard coaxial cable connectors, internal cavities or chambers are formed around the terminal and cable conductor joint and around the bend in the terminal. These chambers often provide sharp corners, other uneven surfaces and alternately narrowing and widening cavities that interfere with the signal passing through the connector and considerably reduce the RF performance of the connection. It seems there has not been a serious attempt to minimize signal loss in this environment in a straightforward manner.

SUMMARY OF THE INVENTION

Accordingly, it is an object of this invention to provide an angled electrical connector with a tuned internal chamber or cavity for minimizing radio frequency interference.

Another object of this invention is to form the tuned cavity by components of the connector interacting as the connector is assembled around a coaxial cable termination or bent terminal for a printed circuit board (PCB).

A still further object of this invention is to furnish a connector having these important characteristics but still utilizing low cost manufacturing and assembly methods.

In carrying out this invention in the illustrative embodiment thereof, the conductor core or central wire of a coaxial cable is crimped to a terminal. The terminal has a right-angle bend providing a change of direction of the cable from a crimp section to a contact section for engagement with a cooperating connection port. A right-angle connector has a main body and a cover. The cover can be opened or separated from the main body to allow insertion of the terminal into the main body. The main body has a curved passageway or channel with an opening that receives the crimp section, bend and contact sections of the terminal. The main body has a partially tubular portion that receives the end of the coaxial cable. The contact section of the terminal is surrounded by an outer contact barrel or socket extending from an output end of the main body. The socket has a dielectric lining.

The cover has a flat portion and a partially tubular portion. The flat portion has a shaped projection that fits into the channel opening when the cover is moved to a closed position with the flat portion seated on the main body. The projection closes the opening and completes assembly of a tuned chamber or cavity by providing a surface that seamlessly merges and matches with the curved passageway. The cavity is L-shaped with a circular cross-section and no sharp corners, obstacles or recesses. The cover is secured in the closed position by a ferrule slid over the partially tubular portion of the cover and the partially tubular portion of the main body, which are now engaged to provide a tube enclosing the end of the cable.

A solid dielectric member may be used to fill the cavity rather than simply using air as the dielectric. The dielectric member would include hinged parts as needed for fitting around the bent terminal and allowing ease of assembly. In a variation of the invention, the tuned cavity is formed in PCB connector. A dielectric member is closed around a bent contact or terminal and then inserted into a connector housing prior to engagement of the terminal and housing with a PCB.

Because of the tuned cavity, the geometry variations caused by the crimp and bend sections of the terminal are virtually eliminated or reduced to a degree that enables the RF connector to function at higher performance levels than were previously achievable. Cost reduction occurs because the open connector and tuned cavity allow use and insertion of the relatively inexpensive crimp connection and common bent center contact. The design, therefore, provides a relatively low cost right-angle cable connector and PCB connector that utilize simple manufacturing and assembling techniques while increasing the RF performance at the same time. Straight action assembly and molding for flexibility in the assembly process and ease of manufacturing, respectively, and the use of basic crimping technology, add up to a very cost-effective design. The assembly can be either manual or automated since the design lends itself to these simple assembly methods.

BRIEF DESCRIPTION OF THE DRAWINGS

This invention, together with other objects, features, aspects and advantages thereof, will be more clearly understood from the following description, considered in conjunction with the accompanying drawings.

DETAILED DESCRIPTION OF THE ILLUSTRATED EMBODIMENTS

Figure 1:
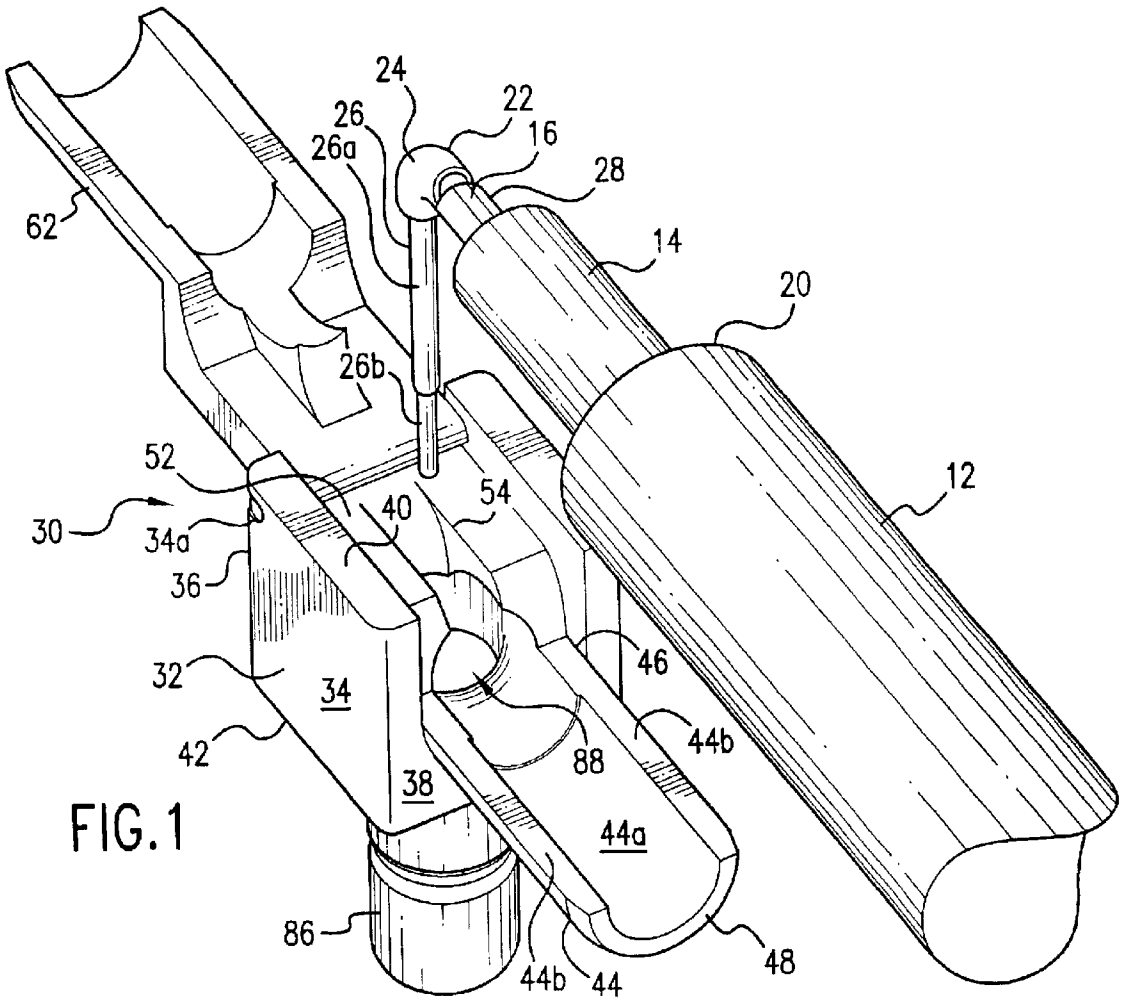
FIG. 1 is a perspective view of a coaxial cable, male bent center contact terminal and open, right-angle connector prior to assembly.

Referring now to FIG. 1, a coaxial cable 12 has an end with a first stripped portion exposing a cable dielectric or inner insulating layer 14 and a second stripped portion exposing a cable center conductor core 16. A conductive sheath 18 (shown partially in FIG. 2) comprising braided or woven wires surrounds the inner insulating layer 14 and is in turn surrounded by an exterior insulating jacket 20.

A terminal 22 manufactured from an electrically conductive material, such as stamped from brass, is attached to the cable core 16. The terminal 22 has a bend section 24 between a pin or center contact 26, and a crimp section 28 having crimp tabs for attachment to the cable core 16 in the conventional manner. The bend section 24 provides for illustrative purposes a right angle turn of the terminal but could be configured to provide terminals at other angles. The center contact 26 has a stepped configuration, transitioning from a slightly wider diameter portion 26*a* adjacent the bend section 24 to a smaller diameter portion 26*b* at the free end of the contact.

A connector or connector housing 30 constructed of an electrically conductive material, for example cast from zinc, receives the terminal 22 and the stripped end of the coaxial cable 12. The connector 30 is illustrated as a right-angle connector to accommodate the right angle terminal 22, but could be formed to accept terminals of other angles. Connector 30 has a main body 32 having two side walls 34, a rear wall 36, a front wall 38, an upper wall 40 and an underside or lower wall 42. The side walls 34 and rear wall 36 are substantially solid or closed. Each side wall 34 forms a semi-circular hinge pocket 34*a* with the rear wall 36 adjacent the upper wall 40. A half-tubular extension 44 extends perpendicularly outward from the front wall 38. The extension 44 has a first end 46 within the main body and a second, free end 48 distal from the main body. The extension has an inner semi-circular surface 44*a* facing or opening upward between two opposite flat edges 44*b*.

Figure 2:
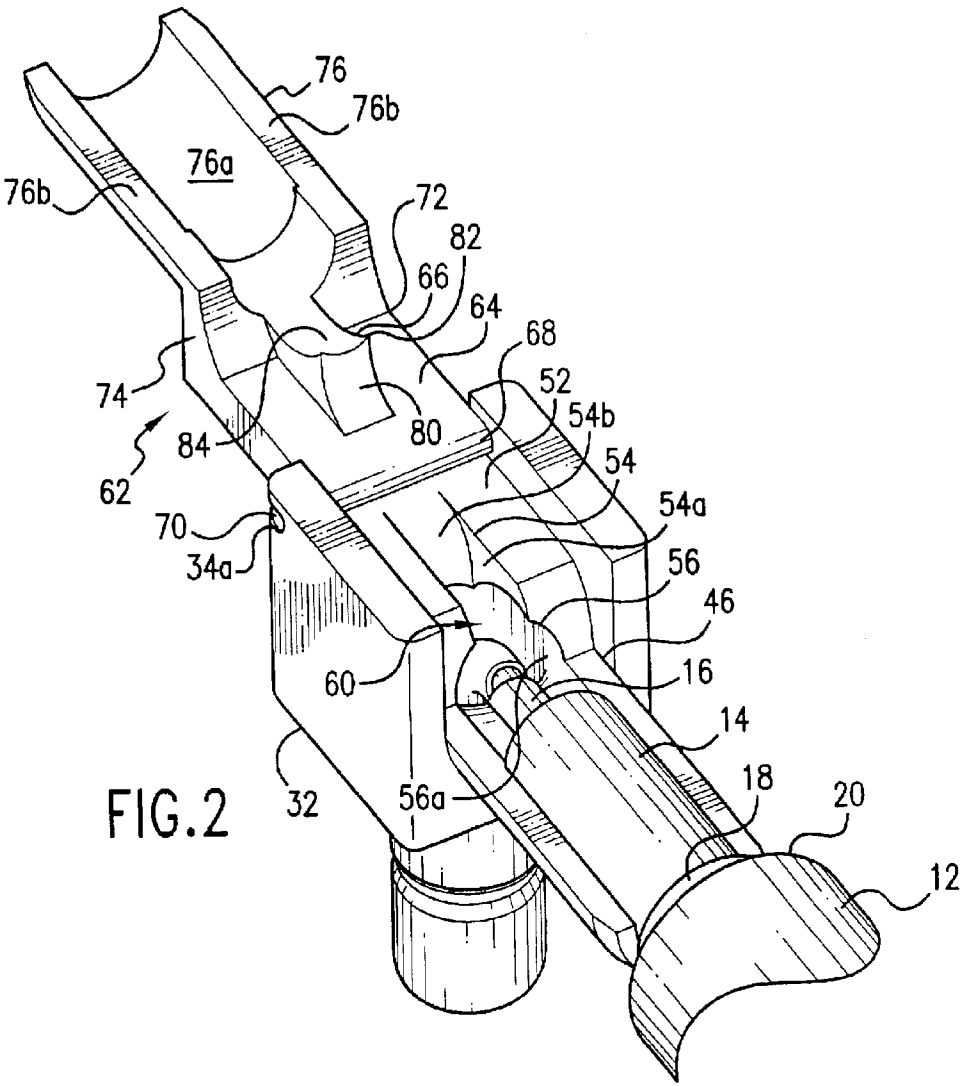
FIG. 2 is a perspective view illustrating the cable and terminal placed in the open connector.
Figure 3:
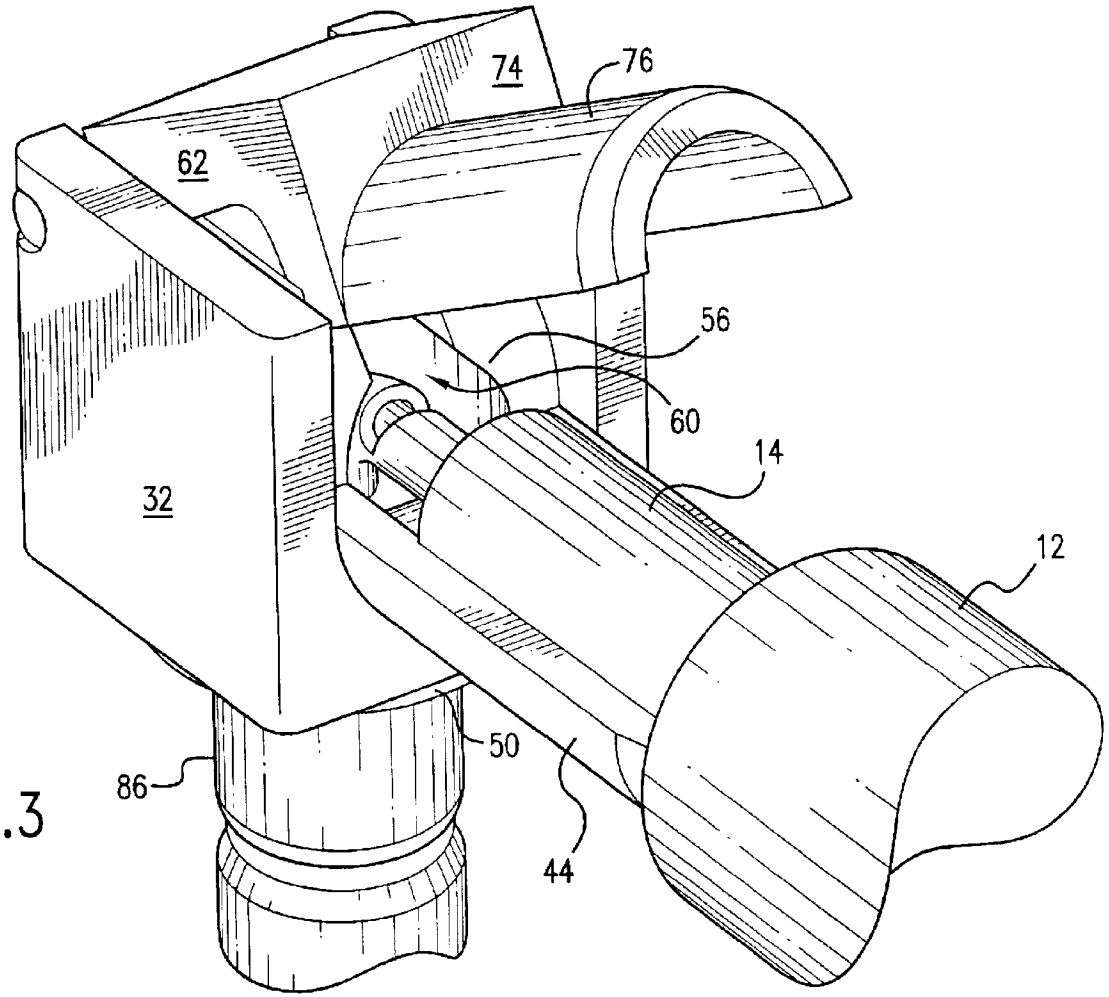
FIG. 3 is a perspective view illustrating the assembly as a cover of the connector is moved toward a closed position.
Figure 7:
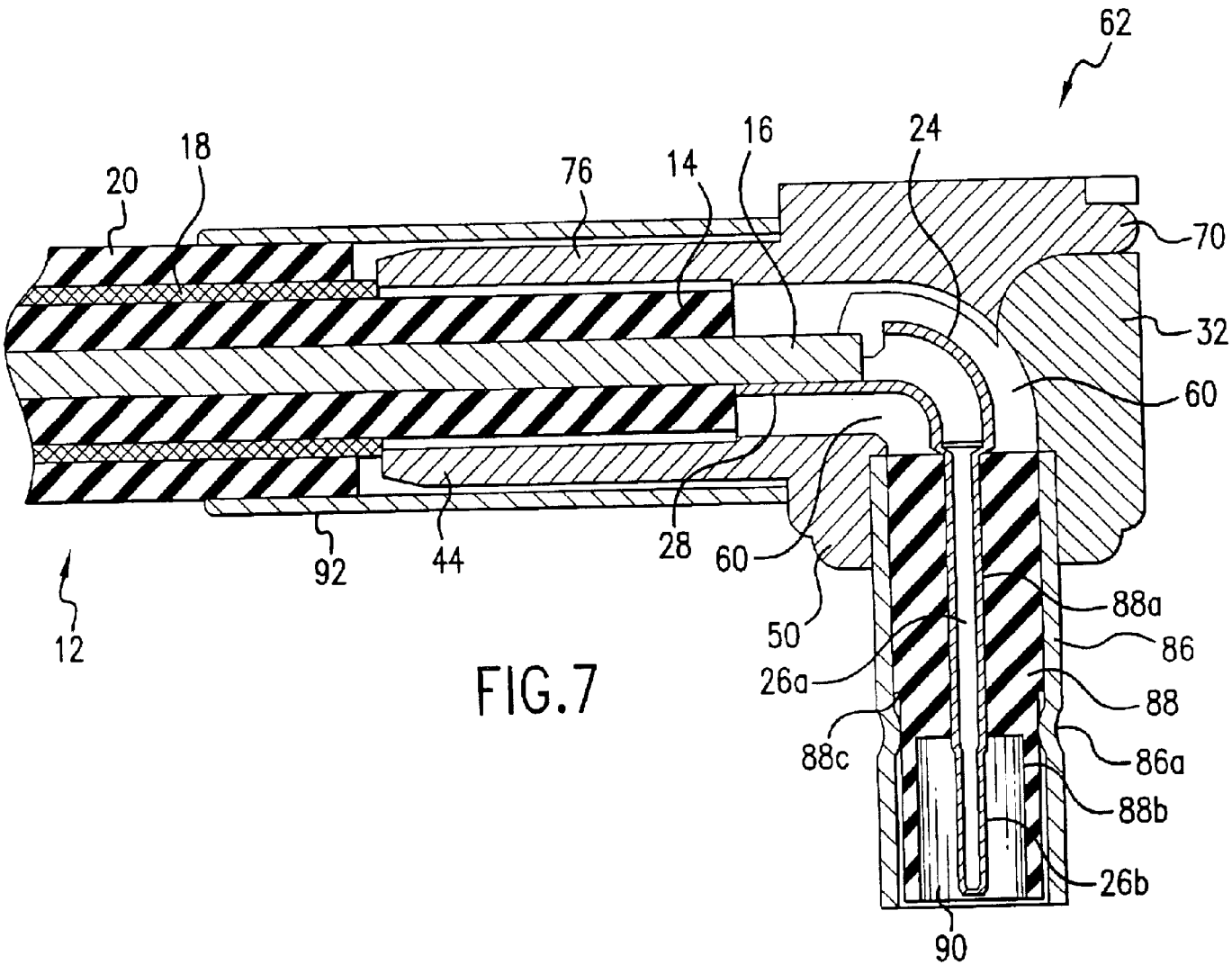
FIG. 7 is a cross-sectional side view of the completed assembly taken along section line A—A of FIG. 6.

The lower wall 42 of the connector main body has an integral short, hollow cylindrical section 50 best shown in FIG. 3 and the cross-section view of FIG. 7. Referring now particularly to FIG. 2, located just within the upper wall of the main body is a recessed block-shaped segment 52 with a central passage 54 communicating with the half-tubular extension 44 and the cylindrical section 50. The passage 54 has two sides 54*a* and a convex-shaped back wall 54*b*. The block-shaped segment is formed as part of the first end 46 of the half-tubular extension 44. The segment provides a partial curved archway 56 just inside of where the half-tubular extension enters the connector main body 32. The archway 56 is open at the top where it meets the passage 54. The archway has inner concave walls 56*a* that converge with the convex back wall 54*b* of the passage 54 in a smooth transition. In other words, as the half-tubular extension enters the connector main body and bends into engagement with the short cylindrical section 50, an L-shaped tubular channel or cavity 60 is formed by the archway 56 and cylindrical section 50, though it is open at the top through the passage 54 to permit insertion of the terminal.

The connector main body 32 has a cover 62, which could also be cast from zinc, for closing over the cavity 60, block-shaped segment 52, and half-tubular extension 44. The cover 62 has a first section 64 that is substantially flat except for a central projection 66. A first end 68 of the flat section 64 has hinge pegs 70 extending from each edge. These pegs are received in the hinge pockets 34*a* of the main body to pivotally join the cover to the main body. A second end 72 of the flat section 64 merges into a short wall section 74 extending substantially perpendicularly (upward in FIGS. 1 and 2) from the flat section. The wall section connects a relatively long half-tubular section 76 of the cover with the flat section. The half-tubular section extends away from the flat section and is substantially equal in length to the half-tubular extension 44 of the connector main body 32. The half-tubular section 76 has an inner semi-circular surface 76*a* curving between flat tube edges 76*b*, and opens upward or in the same direction as the projection 66.

The projection 66 is formed by a first concave surface 80 rising from adjacent the first end 68 of the flat section 64 to a peak 82. A second concave surface 84 rises to the peak 82 from a position on the wall section 74 where the inner semicircular surface 76*a* of the half-tubular section meets the wall section.

Referring now in particular to FIG. 7, the cylindrical section 50 receives a hollow contact socket 86. The contact socket 86 could be made from, for example, stamped brass and is lined with a dielectric material 88, made, for instance, from extruded plastic. The socket 86 and dielectric liner 88 are cylindrical and extend outward from the cylindrical section 50 of main body 32. The liner material has a first internal bore 88*a* sized to snugly receive the wider diameter portion 26*a* of the center contact 26 adjacent the cylindrical section 50 and a second, larger bore 88*b* opening away from the connector 30. The larger bore 88*b* forms an open area 90 around the smaller diameter portion 26*b* of the center contact 26 for receiving a female terminal or connector (not shown) to electrically mate with the center contact. The socket 86 and liner 88 surround the free end of the contact 26 and allow access to the contact. The liner has an external shoulder 88*c* approximately mid-way along its length that forms a step-down in diameter, enabling the liner to be inserted into the contact socket past an inwardly protruding annular groove 86*a* of the contact socket. The groove 86*a* is required on the socket for standard connection purposes. The liner is first inserted into the socket and held within by an interference fit. Then the socket may be secured to the cylindrical section 50 by a press fit.

As illustrated in FIG. 2, during assembly the terminal 26 is inserted into the cavity 60 and the half tubular extension 44 receives the exposed inner insulating layer 14 of the coaxial cable. When the cover 62 is swung about the hinge pegs 70, as depicted in FIG. 3, to a closed position over the connector main body 32, the projection 66 enters the passage 54. The first concave surface 80 fits against the convex back wall 54*b* of the passage 54 as the flat section 64 of the cover seats on the recessed block-shaped segment 52 and the flat tube edges 76*b* of the half-tubular section 76 seat against the flat edges 44*b* of the half-tubular extension 44. The half-tubular section 76 of the cover and half-tubular extension 44 of the main body form a tight, complete tube or barrel around the inner insulating layer 14 of the cable 12. The second concave surface 84 of the projection 66 merges with edges of the archway 56, completing assembly and closure of the cavity 60. The channel or cavity 60 now has a constant circular cross-section taken at each position along the bend perpendicular to a signal path through the terminal.

Figure 4:
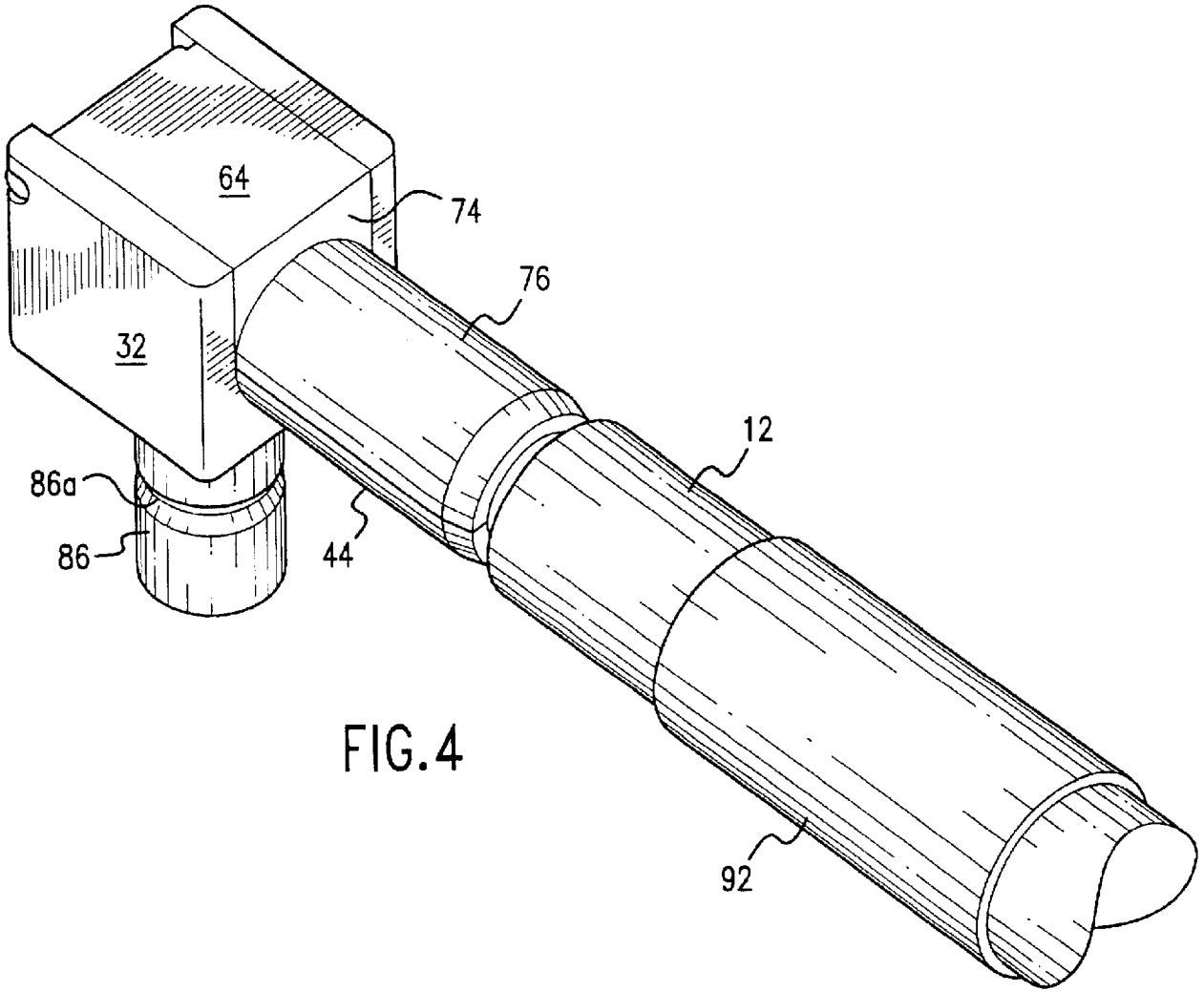
FIG. 4 is a perspective view of the assembly prior to sliding a ferrule over mating parts of the connector.
Figure 5:
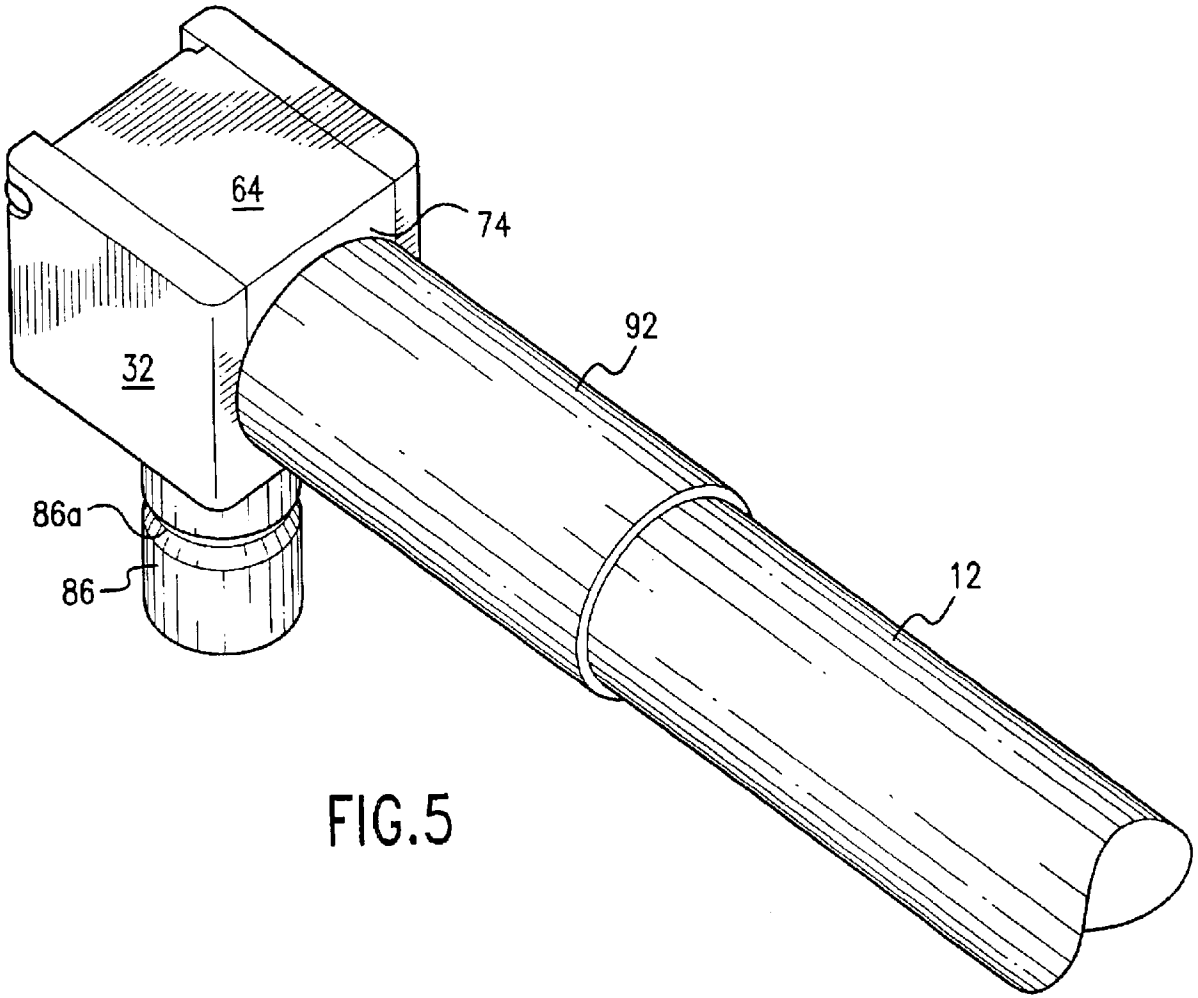
FIG. 5 is a perspective view of the completed assembly.
Figure 6:
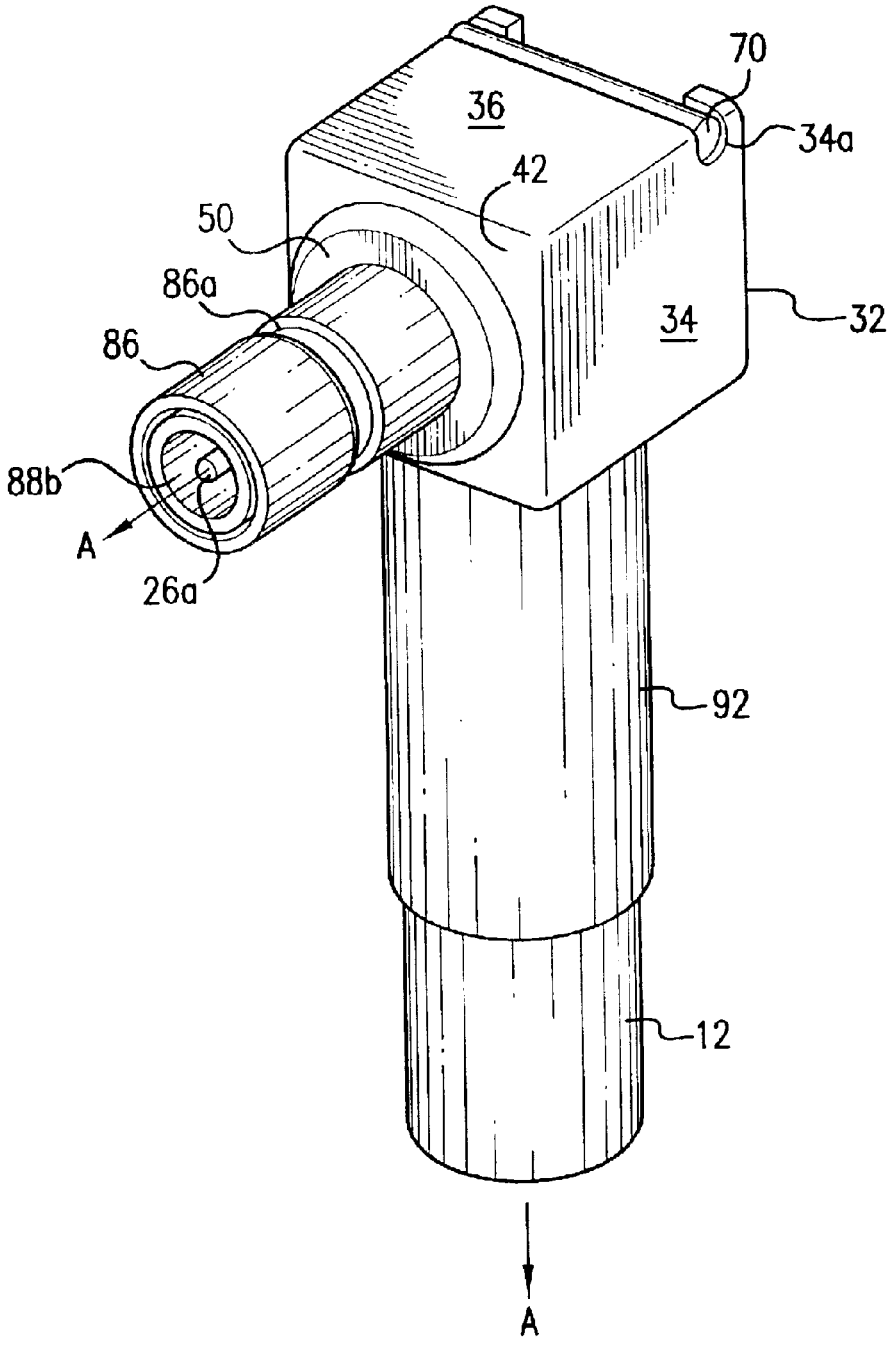
FIG. 6 is a perspective view of the assembly from the electrical mating end.

As best illustrated in FIGS. 4 and 5, a hollow cylindrical ferrule 92, made for example from stamped brass, is placed over an un-stripped portion of the coaxial cable adjacent the stripped end prior to assembly of the cable, terminal and connector. As a final assembly step, the ferrule 92 is slid forward around the now engaged half-tubular extension 44 of the main body and the half-tubular section 76 of the cover to hold the cover in a closed position on the main body and secure the terminal 22 in the connector 30. The ferrule 92 is crimped onto the barrel formed by the half-tubular extension 44 and the half-tubular section 76 through use of a conventional crimp tool. The ferrule 92, for example, grips the barrel, securing the half-tubular extension and half-tubular section together with the conductive sheath 18 in electrical contact with the barrel. A more secure engagement between the cable and connector and better electrical connection between the conductive sheath and the barrel could be obtained by not trimming the original length of the conductive sheath, and sandwiching the conductive sheath between the ferrule 92 and the barrel prior to crimping. In yet another alternative, the conductive sheath could be sandwiched between the barrel and the coaxial cable insulation layer 14. The ferrule 92 along with the contact socket 86 act as grounds and shields for the cable and terminal.

The invention provides a tuned cavity 60 that is smooth, contoured and thereby notable for the absence of obstacles and geometry variations in the bend area of the terminal and cavity. Due to this geometry configuration the tuned cavity can operate at higher frequencies, up to 6 GHz as compared to existing connectors that operate at under 3 GHz. This is an emerging requirement for current and future RF connectors. If cross-sections are taken perpendicular to the line of signal travel path, the cross-sections remain considerably similar around the ninety-degree bend through the cavity. The electrical signal can traverse that distance with minimum radio frequency interference in the tuned cavity. Essentially, the tuned cavity simulates bent coaxial cable.

An outer housing of electrically non-conductive plastic would be fit over the connector in use. The connector, though illustrated as male, could be a female connector. Again, though illustrated as a right angle connector, it can be any angle less than one-hundred-eighty degrees to accommodate similarly bent terminals. The cover need not be hinged to the main body of the connector. It can be provided as separate part. In addition, though air makes the best dielectric for the tuned cavity and reduces the RF interference to a minimum, a dielectric plastic which could be a thermoplastic polyester such as polybutylene-terephalate (PBT), Teflon, or a any of a variety of extruded plastics, could be used to fill the tuned cavity between the center contact and the outer contoured walls.

Figure 8:
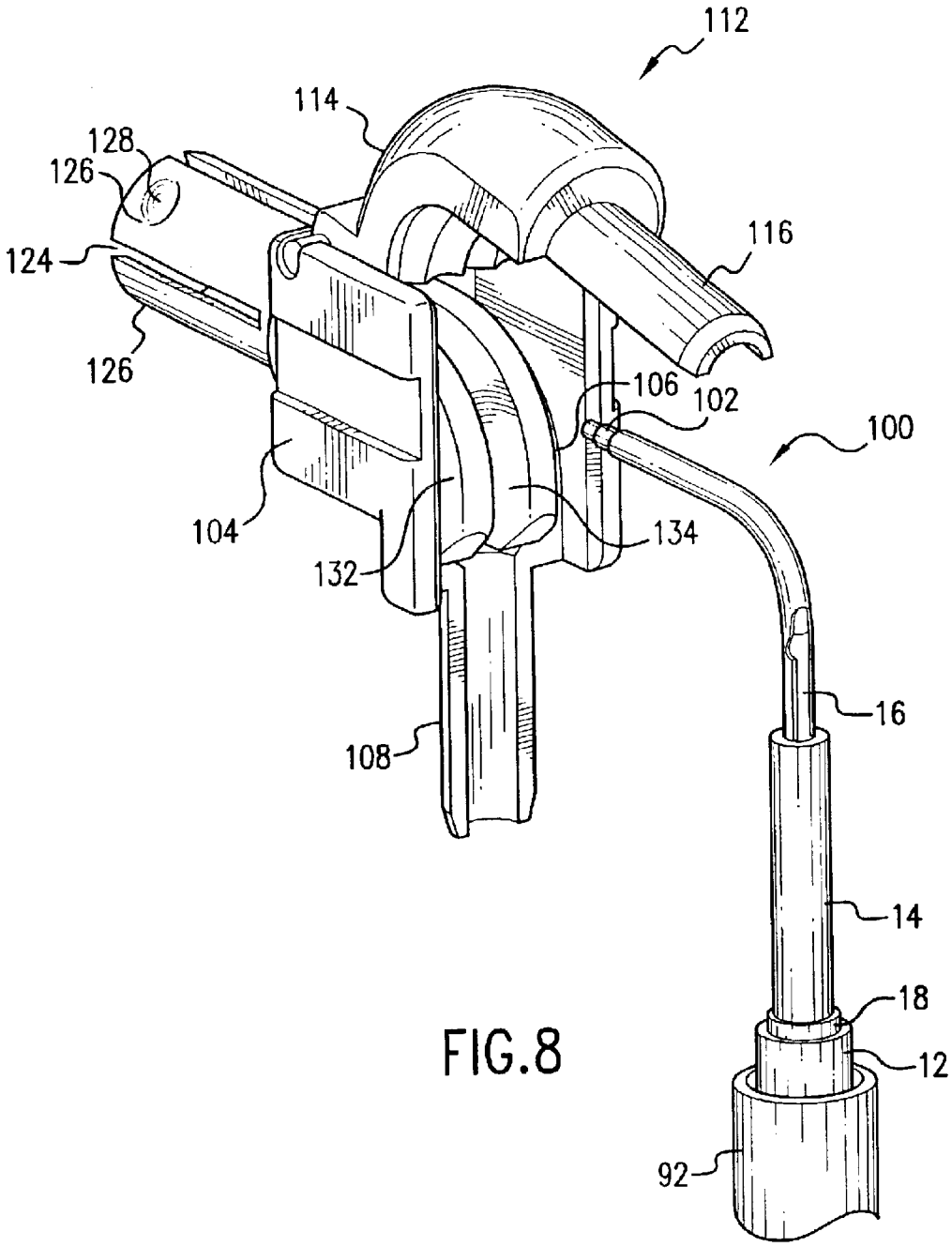
FIG. 8 is a perspective view of a coaxial cable, female bent terminal and open, right-angle connector prior to assembly.
Figure 9:
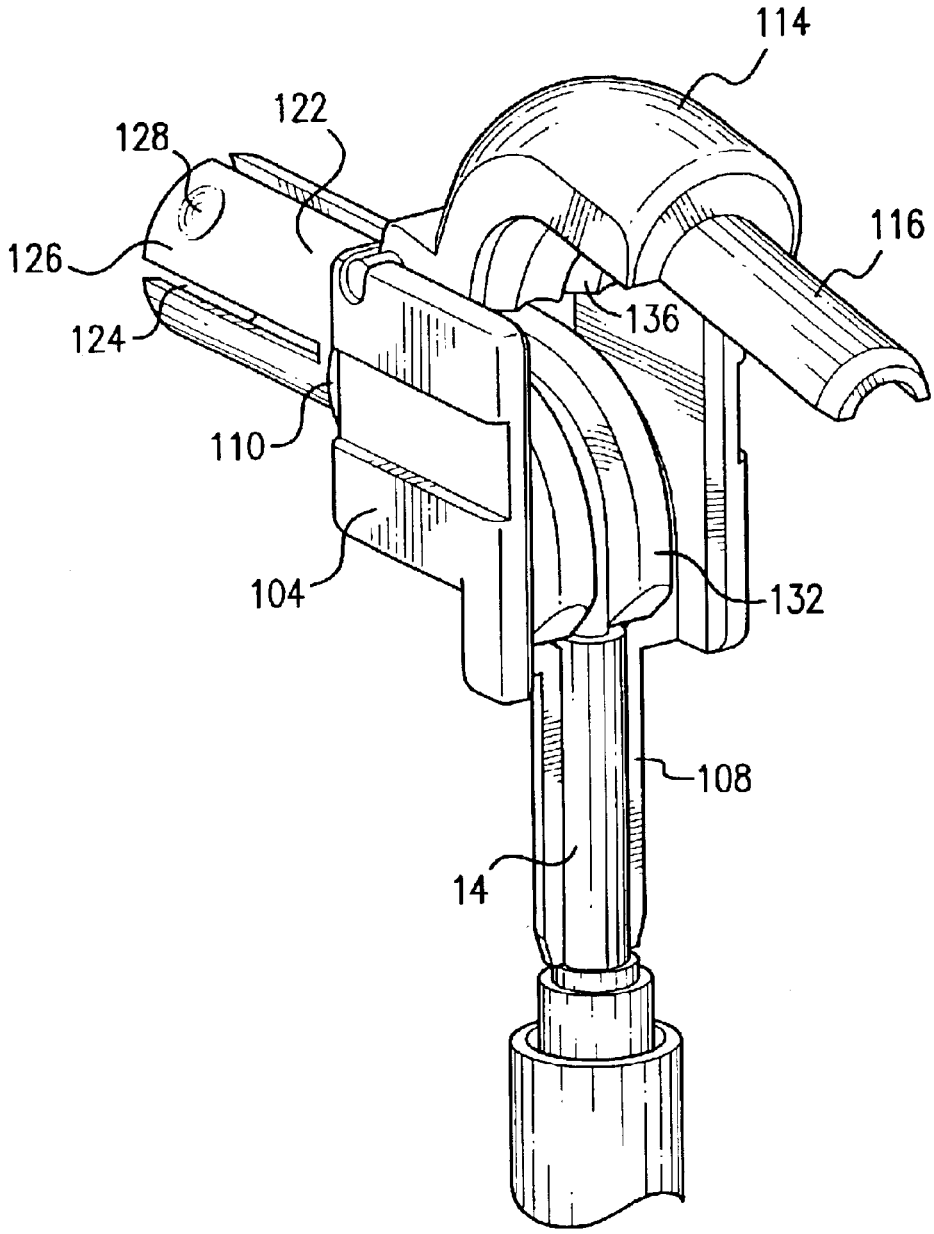
FIG. 9 is a perspective view illustrating the cable and terminal placed in the open connector.

FIGS. 8–12 illustrate a second embodiment of the invention wherein the cable connector is used with a female terminal, and a dielectric material rather than air is used in the tuned cavity. All other aspects of the invention are substantially the same or similar, and like components are identified by the same reference numbers. Referring now to FIGS. 8 and 9, a bent or right-angle female terminal 100 is crimped to the center conductor 16 of the coaxial cable 12. The terminal has an open free end 102 for receiving a pin contact of a male terminal or connector (not shown). A right-angle connector has a main body 104 with a curved central passage 106. A half-tubular extension 108 extends from the main body for receiving an end of the cable stripped to insulation layer 14. A hollow, short cylindrical section 110 extends from the main body at a right angle to the half-tubular extension at an opposite end of the central passage 106.

A cover 112 is hinged to the main body. The cover includes a rounded cap or shell section 114 adjacent the hinge. Projecting from the shell section is a half-tubular section 116 for closing around the insulation layer 14 of the cable and engaging the half-tubular extension 108 of the main body to form a closed tube around the cable end. The shell section 114 has a curved inner surface 118, best shown in the cross-sectional view of FIG. 12, forming the upper part of an interior wall of the passage 106 when the cover is swung to the closed position. In other words, an L-shaped, tubular, tuned cavity 120 is formed within the main body and cover by the curve of the central passage 106 and the curved inner surface 118 of the cover shell section. The tuned cavity is smooth in configuration and presents no obstacles or sharp corners. It has a constant cross-section when taken perpendicular to the signal path around the bend of the female terminal 100.

A contact barrel or socket 122 is fit into the cylindrical section 110 and configured to receive a standard male connector for mating with the female terminal 100. An inner wall of the socket forms part of, and increases the length of, the tuned cavity 120. The socket includes slits 124 for providing flexibility to formed contact arms 126. Depressions 128 in the outer surfaces of the contact arms cause or form inner protuberances 130 for ensuring resilient or spring contact with the mating connector structure.

In this embodiment, a dielectric member 132 for the tuned cavity 120 is used rather than simply using air as a dielectric. The member, as previously mentioned, could comprise a thermoplastic polyester, such as polybutylene-terephalate (PBT), Teflon, or any of a variety of extruded plastics. The dielectric member is tubular and L-shaped, or bent in what ever angle is needed to match the terminal and connector angle. It has a central channel 134 sized to snugly receive the terminal. In order to fit around the entire length of the terminal, and allow insertion of a bent terminal into the dielectric member, the member 132 has a part 136 joined to it by, for example, a living hinge 138. The part 136 is shaped to fit into the shell section 114 of the cover and move with the cover. The dielectric member is first assembled within the main body 104 and cover 112. The socket 122 is press-fit between the dielectric member 132 and the cylindrical section 110. The dielectric part 136 is closed around bend and crimp sections of the terminal 100 after the terminal is placed in the connector and through the dielectric member. The dielectric member has a reduced diameter part 140 surrounding the mating or free end 102 of the female terminal around which the standard male connector fits when inserted into the socket 122.

Figure 10:
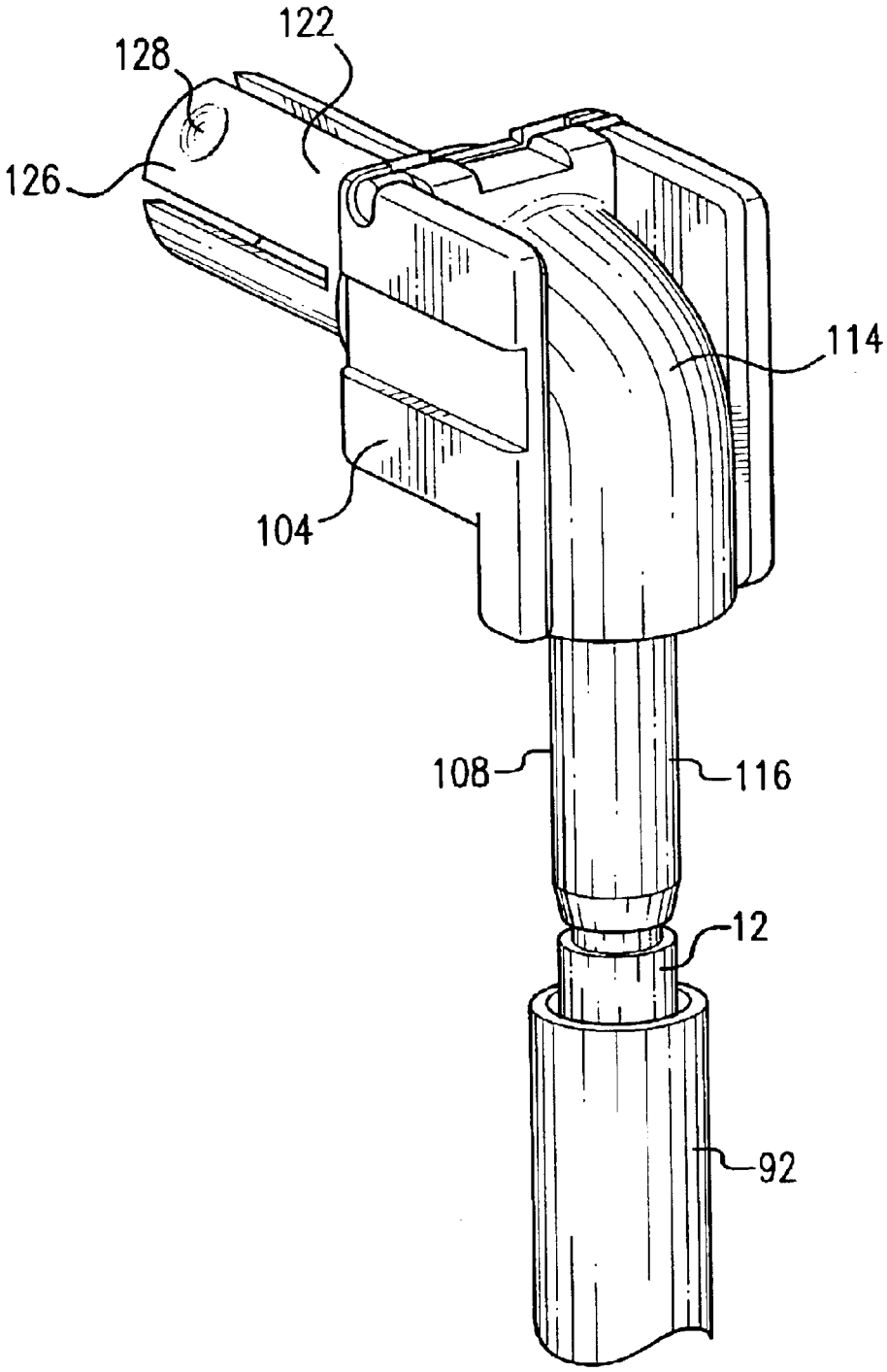
FIG. 10 is a perspective view showing a cover of the connector in a closed position over the terminal and cable.
Figure 11:
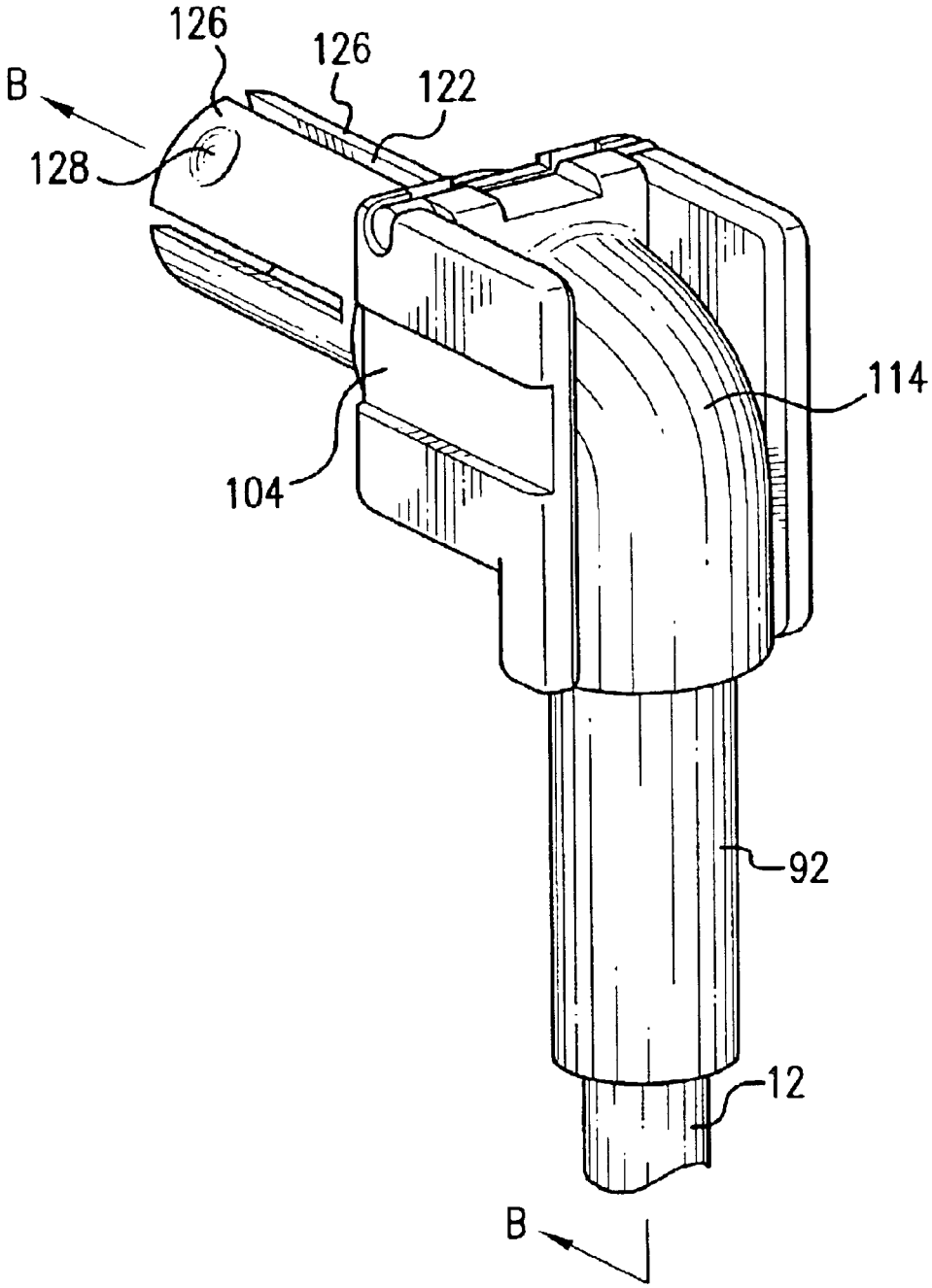
FIG. 11 is a perspective view showing a ferrule slid over parts of the connector to hold the cover in the closed position.
Figure 12:
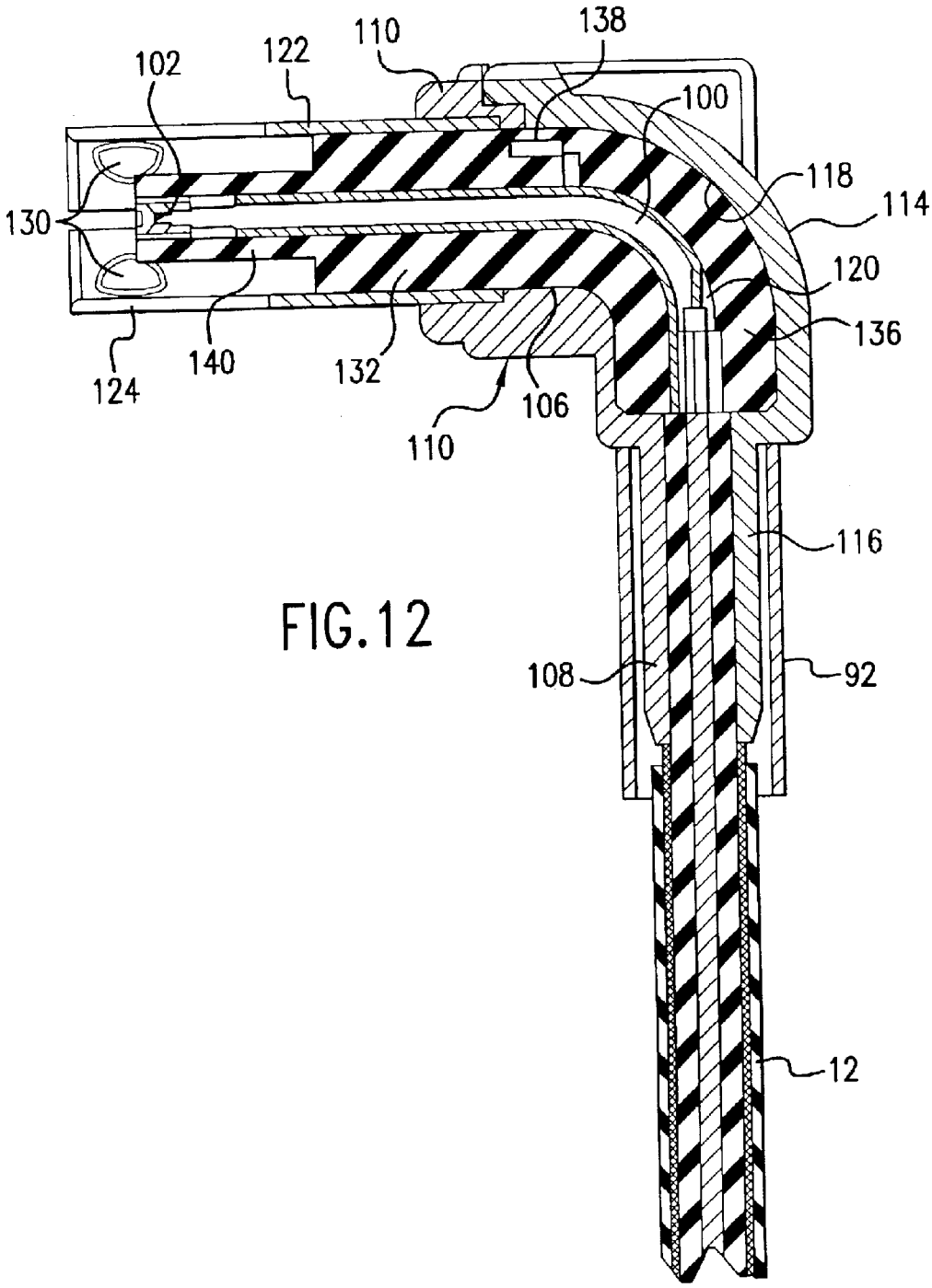
FIG. 12 is a cross-sectional side view of the completed assembly taken along section line B—B of FIG. 11.

As in the previous embodiment and as demonstrated in FIGS. 10 and 11, a ferrule 92 previously fit around an un-stripped part of the coaxial cable 12 is slid over the tube formed by the half-tubular section 116 of the cover and the half-tubular extension 108 of the connector main body. The ferrule is crimped in position to hold the connector around the end of the cable and the cable and terminal within the connector.

The tuned cavity 120 again provides a contoured, unobstructed path for the signal traveling through the dielectric member 132. RF interference is minimized in a low-manufacturing-cost and simple-to-assemble connector. The cable connector can be configured to accept terminals bent at angles other than ninety degrees. The dielectric part 136 could be attached to the dielectric member 132 in ways other than by a living hinge, or could simply be secured in the cover 112. An electrically non-conductive housing of plastic or similar material would enclose the connector in use.

Figure 13:
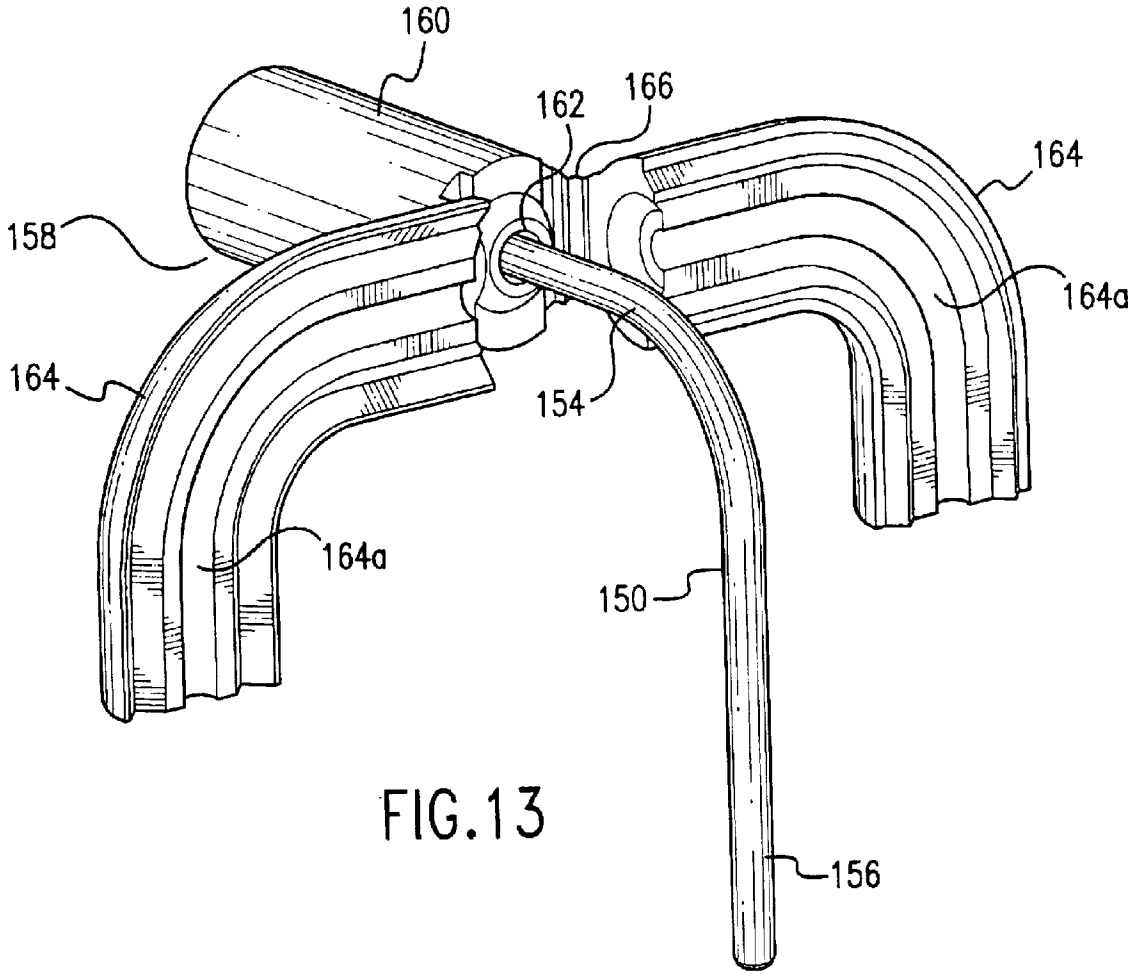
FIG. 13 is a perspective view of an open, hinged dielectric member placed around a bent center contact terminal.
Figure 14:
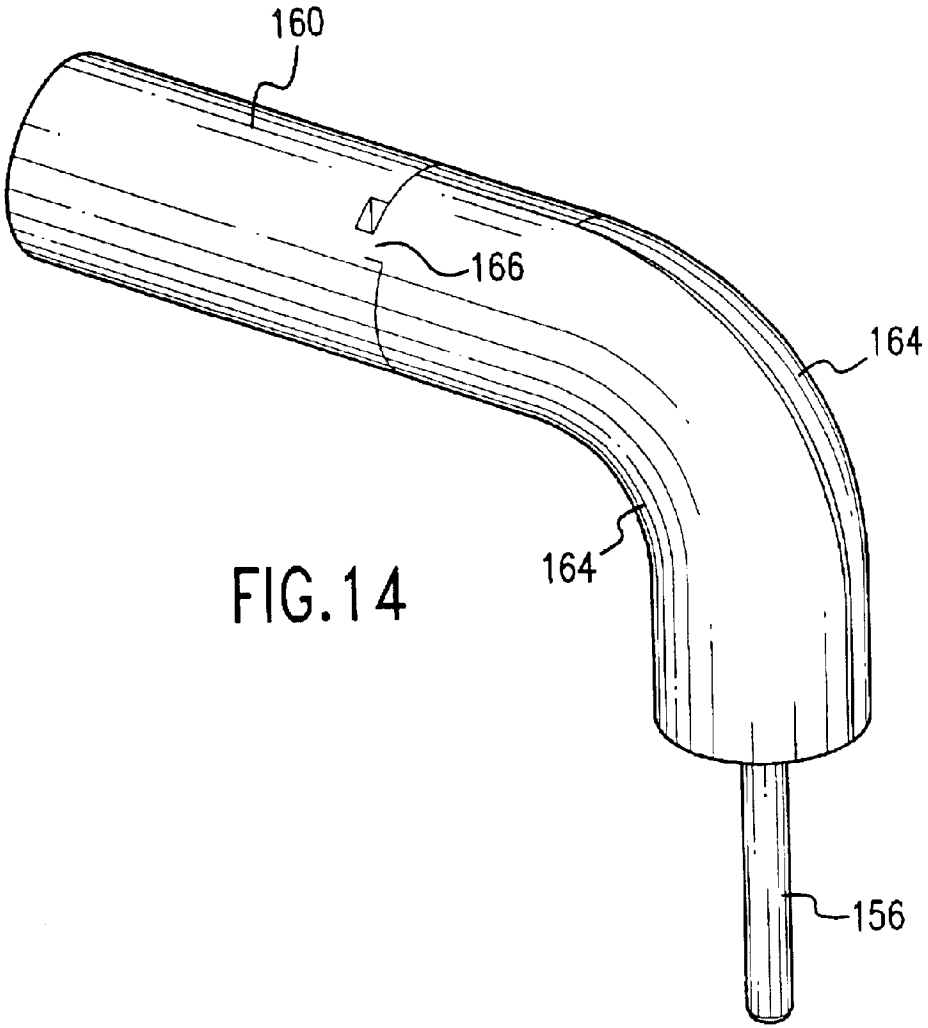
FIG. 14 is a perspective view illustrating the dielectric member of FIG. 13 closed around the bent center contact terminal.
Figure 15:
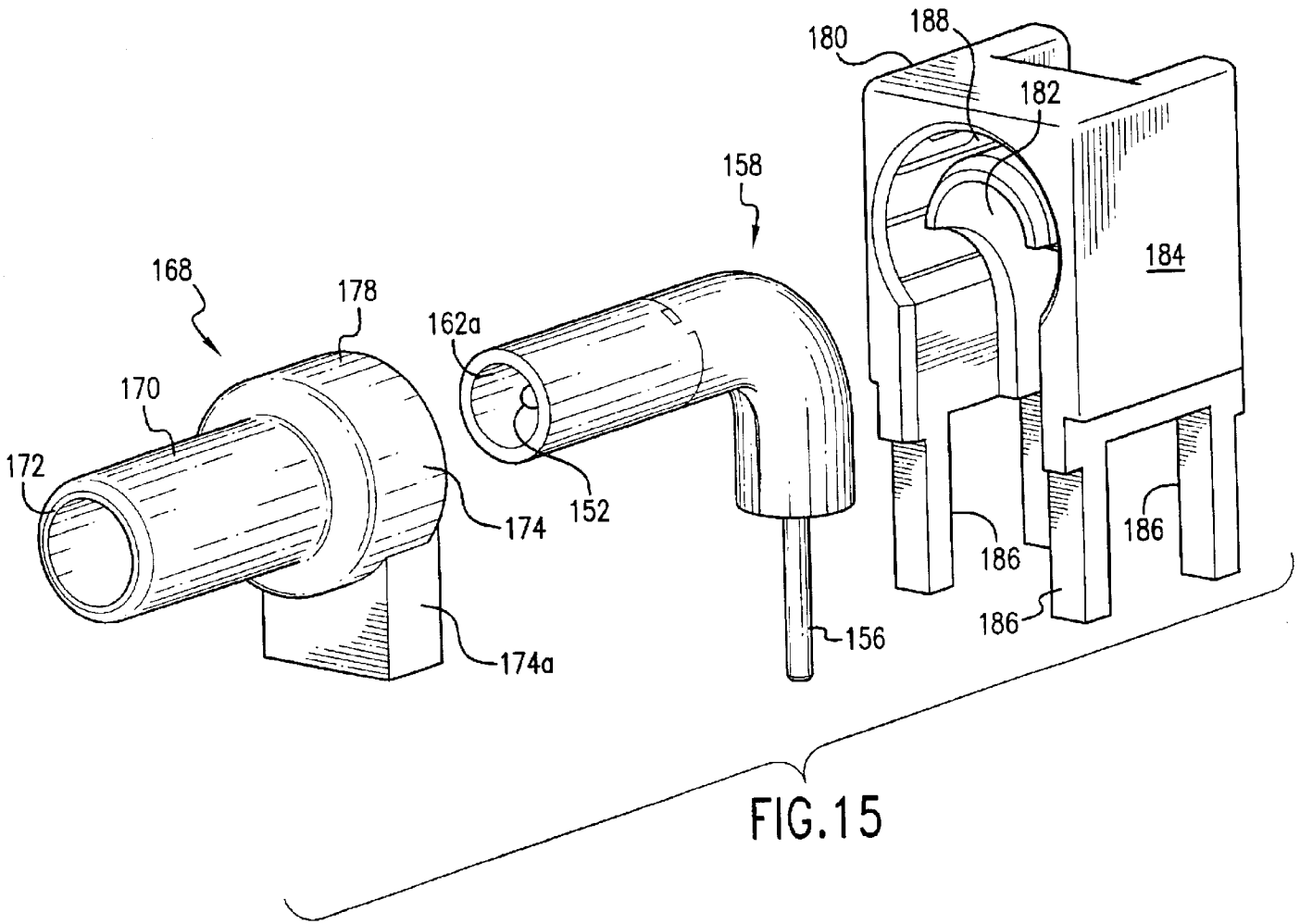
FIG. 15 is an exploded perspective view of the dielectric member and terminal in combination with separated components of a printed circuit board connector prior to assembly.
Figure 16:
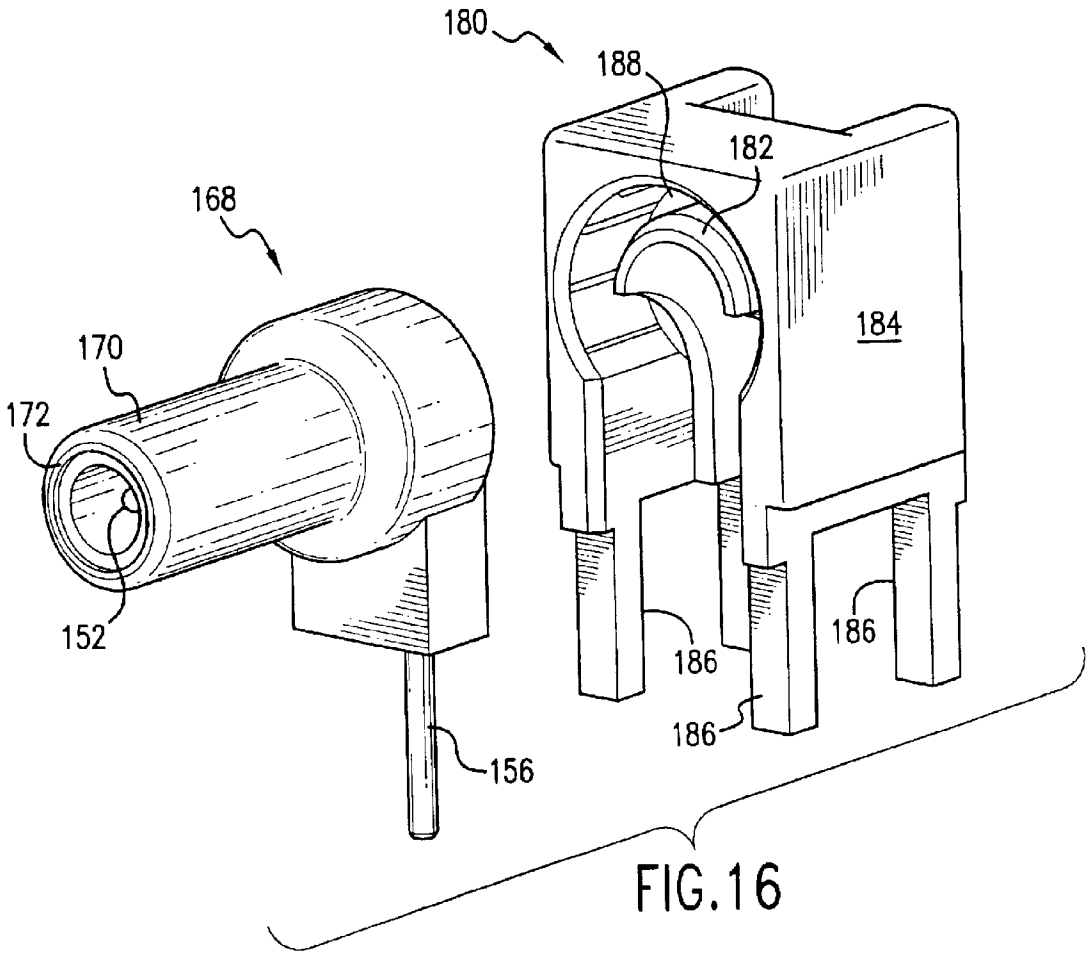
FIG. 16 is an exploded perspective view showing the dielectric member fit into an outer contact barrel component prior to assembly with a cover component.
Figure 17:
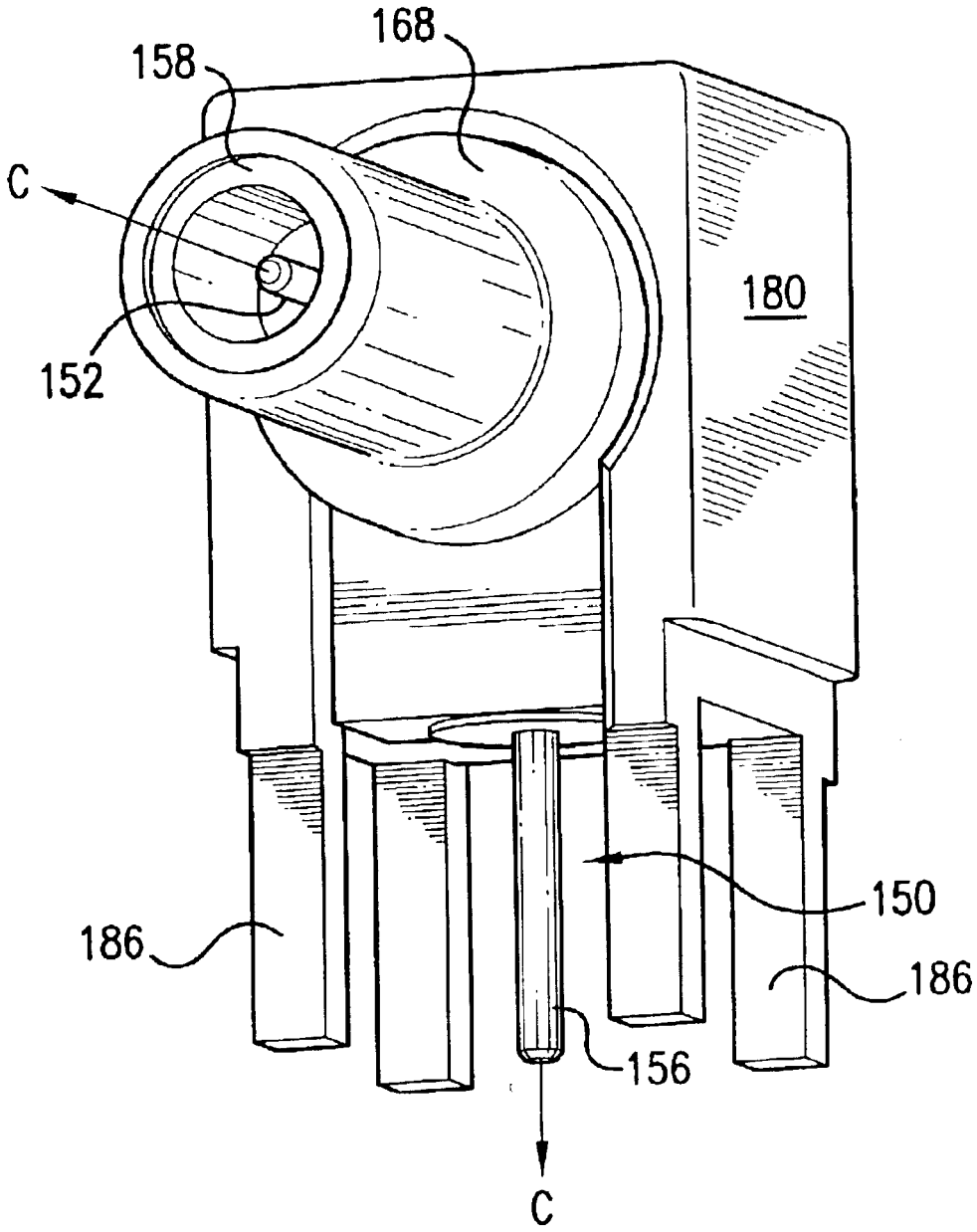
FIG. 17 is a perspective view of the completed printed circuit board connector assembly.

The concept of the tuned cavity can be used in a printed circuit board (PCB) connector for a coaxial cable as well, as illustrated in FIGS. 13–18. Referring first to FIGS. 13–15, a male terminal 150 comprises a center contact of, for example, stamped brass. The terminal has a mating or contact end 152, a bend portion 154 and a PCB connection end 156. Because of assembly requirements of the PCB connector, the terminal is first inserted into a dielectric member 158. The dielectric member has a main tube section 160 with a central passage 162 for snugly receiving the contact end 152 of the terminal. As shown in FIG. 15, the central passage 162 increases in diameter immediately adjacent a mating part of the contact end 152 of the terminal to form a surrounding recess 162*a*. Two elbow-shaped half-tubular sections 164 with matching central passages 164*a* are joined to the main tube section by, for example, living hinges 166. The half-tubular sections 164 fit around the bend portion 154 and part of the PCB connection end 156 of the terminal when closed to a mutually engaged position, illustrated in FIG. 14.

Figure 18:
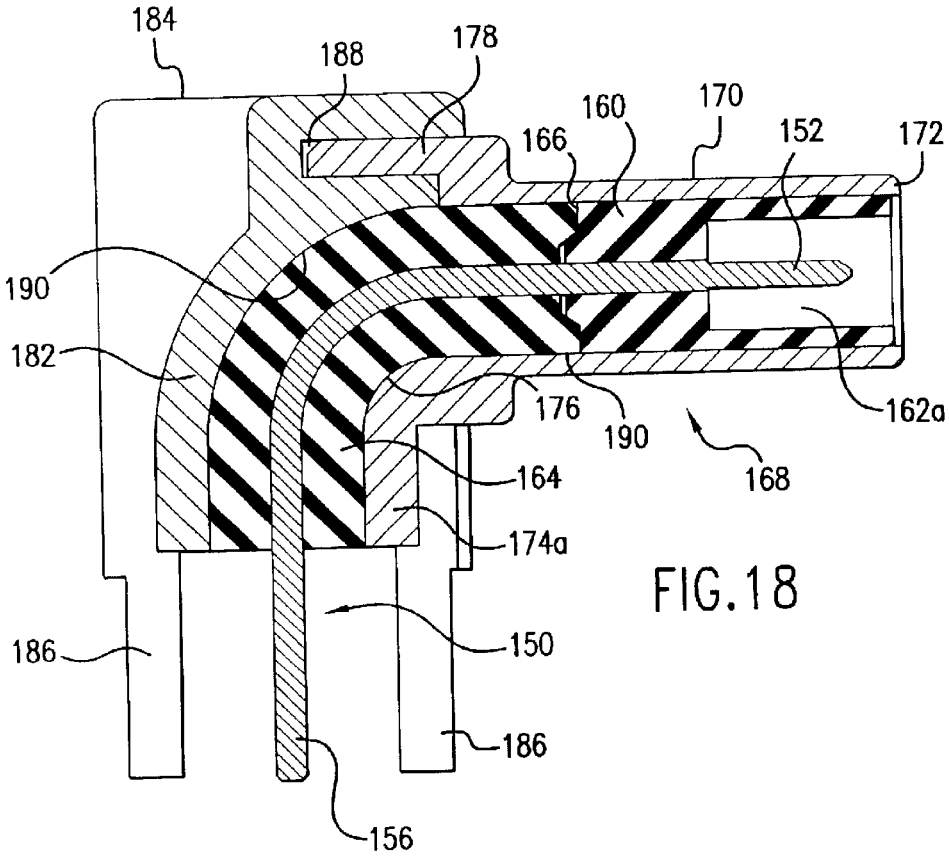
FIG. 18 is a cross-sectional side view of the completed assembly taken along section line C—C of FIG. 17.

The dielectric member 158 is then press-fit into an outer contact barrel 168, best illustrated in FIGS. 15 and 18. The contact barrel essentially forms a connector main body and could, for example, be cast from zinc. The barrel 168 has a hollow cylindrical section 170 with a free end 172. Opposite the free end, the cylindrical section 170 is integral with a flared receiving section 174. The flared receiving section has a wall 174*a* with a lower rounded or curved inner surface 176 shaped to follow the turn of the bend portion 154 of the terminal 150, and a flanged upper part 178.

The dielectric member 158 is press-fit into the outer contact barrel 168 (FIG. 16) such that the contact end 152 of the terminal 150 is accessible through the free end 172 of the barrel 168 and the PCB connection end 156 of the terminal extends downward from the flared receiving section 174 of the barrel. This press-fit also serves to hold the half-tubular sections 164 of the dielectric member in the closed position around the terminal if they are not latched in some other manner. Next, the outer contact barrel is press-fit into a connector cover 180. The connector cover would be manufactured from an electrically conductive material, such as cast from zinc. The connector cover comprises a center part-circular shell 182 formed integral within an outer rectangular housing 184. Four legs 186 extend from the housing for receipt in apertures in the PCB to support the connector on the board. An annular recess 188, best shown in FIG. 16, between the shell 182 and housing 184 receives the flanged upper part 178 of the flared receiving section 174 of the barrel 168 to provide structure for the press-fit. As illustrated in FIG. 18, the center part-circular shell 182 forms a tuned cavity 190 with the lower curved inner surface 176 of the flared receiving section and the cylindrical section 170 of the barrel.

The tuned cavity 190 is smoothly contoured, rounded L-shaped, tubular, and corner or obstacle free. It provides a passage of constant cross-section taken perpendicular to the signal path through dielectric member 158, minimizing RF interference. The PCB connection end 156 of the center contact terminal 150 makes connection with a conductive trace or other component on the PCB, and the male contact end 152 of the terminal can engage a female connector on a coaxial cable received by barrel 168.

As with the previously described cable connectors, the PCB connector can be configured to receive terminals having bends different than ninety degrees. The PCB connector would be covered by a housing made from an electrically non-conductive material. Also, a female center contact terminal can be used rather than the male terminal 150. The dielectric member 158 can be formed by pieces that snap together in some manner other than the illustrated living hinge design.

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. A connector for receiving a bent electrical terminal attached to a conductive core of a cable at an end of the cable, the connector comprising:

a main body having a cavity for receiving the bent terminal, the main body including a curved archway having an opening for receiving the, bent terminal; and a cover for closing the cavity as the cover is fit on the main body, the cover the having a projection, the projection including a plurality of straight side extending to two concave surfaces, the projection forming part of the cavity, the curved archway and one of the concave surfaces merging when the cover and main body are fit together to provide a contoured cavity bend matching the bent terminal in direction change.

2. The connector of claim 1 wherein the cavity is shaped such that cross sections taken perpendicular to a signal path through the terminal are constant in shape and size.

3. The connector of claim 1 further comprising a half-tubular portion extending from the main body for receiving the end of a cable attached to the terminal.

4. The connector of claim 3 wherein the cover includes a half-tubular portion for engaging the half-tubular portion of the main body when the cover is fit on the main body, the engaged half-tubular portions forming a complete tube around the end of the cable.

5. The connector of claim 4 further comprising a ferrule for sliding over the complete tube and holding the main body and cover in the closed position around the cable.

6. The connector of claim 1 wherein the main body has a cylindrical section for receiving a contact socket to surround a free, mating end of the terminal.

7. The connector of claim 6 wherein the contact socket is lined with a dielectric material.

* * * * *

UNITED STATES PATENT AND TRADEMARK OFFICE

CERTIFICATE OF CORRECTION

PATENT NO. : 6,817,899 B1
DATED : November 16, 2004
INVENTOR(S) : Arkady Y. Zerebilov It is certified that error appears in the above-identified patent and that said Letters Patent is hereby corrected as shown below:

Column 8,
Line 65, delete the comma immediately after "the";
Line 67, delete "the" (second occurrence);

Column 9,
Line 1, delete "side" and insert -- sides --.

Signed and Sealed this

First Day of February, 2005

JON W. DUDAS
*Director of the United States Patent and Trademark Office*